US005864986A

United States Patent [19]

Schnarr

[11] Patent Number: 5,864,986

[45] Date of Patent: Feb. 2, 1999

[54] CHECKING DEVICE FOR ROLLER SUPPORTED DOORS

[75] Inventor: Raymond H. Schnarr, Princeton, Ill.

[73] Assignee: Schlage Lock Company, San Francisco, Calif.

[21] Appl. No.: 994,421

[22] Filed: Dec. 19, 1997

Related U.S. Application Data

[60] Provisional application No. 60/038,939 Mar. 7, 1997.

[51] Int. Cl. [6] ..... E05F 15/00

[52] U.S. Cl. ..... 49/138; 49/15

[58] Field of Search ..... 49/404, 409, 414, 49/425, 138, 15, 139, 140

[56] References Cited

U.S. PATENT DOCUMENTS

| | | | |
|---|---|---|---|
| 1,606,049 | 11/1926 | Youngblood . | |
| 2,423,129 | 7/1947 | Tobias | 188/33 |
| 2,526,503 | 10/1950 | Raque | 49/138 |
| 3,378,952 | 4/1968 | Bidelman et al. | 49/138 |
| 3,431,678 | 3/1969 | Stuart et al. | 49/360 |
| 3,564,772 | 2/1971 | Ozier et al. | 49/15 |
| 4,067,144 | 1/1978 | Ogishi | 49/360 |
| 4,912,878 | 4/1990 | Bently | 49/379 |

*Primary Examiner*—Jerry Redman
*Attorney, Agent, or Firm*—Michael H. Minns

[57] ABSTRACT

A check mechanism is provided to regulate door speed of a roller supported sliding door as the door is manually opened or closed. The mechanism is attached to a door hanger and uses a rocker arm, which slides along a control track. The control track has elevated or offset control regions which cause the rocker arm to apply force to a brake arm through an adjustable spring. The brake arm pivots to apply braking force through a brake pad to a door roller. The control track may contain regions of no control or of lesser control to allow the door to slide freely between opening or closing regions of control.

15 Claims, 4 Drawing Sheets

CHECKING DEVICE FOR ROLLER SUPPORTED DOORS

This application claims the benefit under 35 U.S.C.§119 (e) of the United States provisional application no. 60/038, 939, filed Mar. 7, 1997.

BACKGROUND OF THE INVENTION

This invention relates generally to checking the movement of prison doors and more particularly to a means for controlling the speed of roller supported sliding prison doors.

In many prisons, heavy roller supported sliding doors are used to close prison cells. Sometimes, prisoners will slam the doors open or closed which can damage latches, locks, wheel bearings, limit switches and other door hardware.

The foregoing illustrates limitations known to exist in present prison doors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a means for regulating the speed of a roller supported door, the means comprising: a control track; a spring biased track follower slidably engaging the control track; a brake operably engaging the track follower, the brake engaging one of the door rollers.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

An object of the invention is to provide a means to regulate the speed of sliding prison cell doors as they are opened and closed. The cell doors typically weigh about 300 pounds and are freewheeling. In some installations, the cell doors are opened and closed remotely. In other installations, the cell doors are opened and closed manually.

Figure 1:
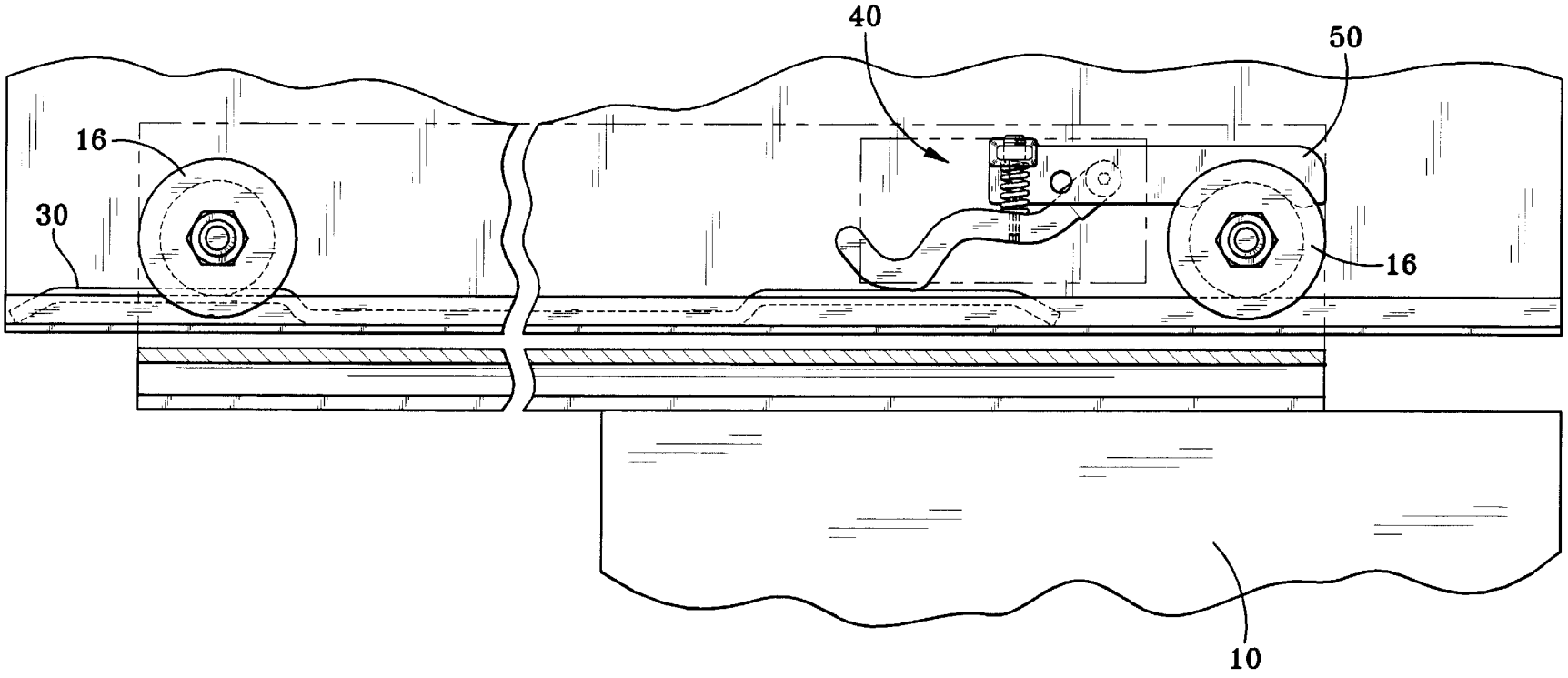
FIG. 1 is a front view of a roller supported door with the speed checking device of the present invention attached with the door in a primary control region of travel, portions of the door support mechanism have been omitted to more clearly show the speed checking device.
Figure 1A:
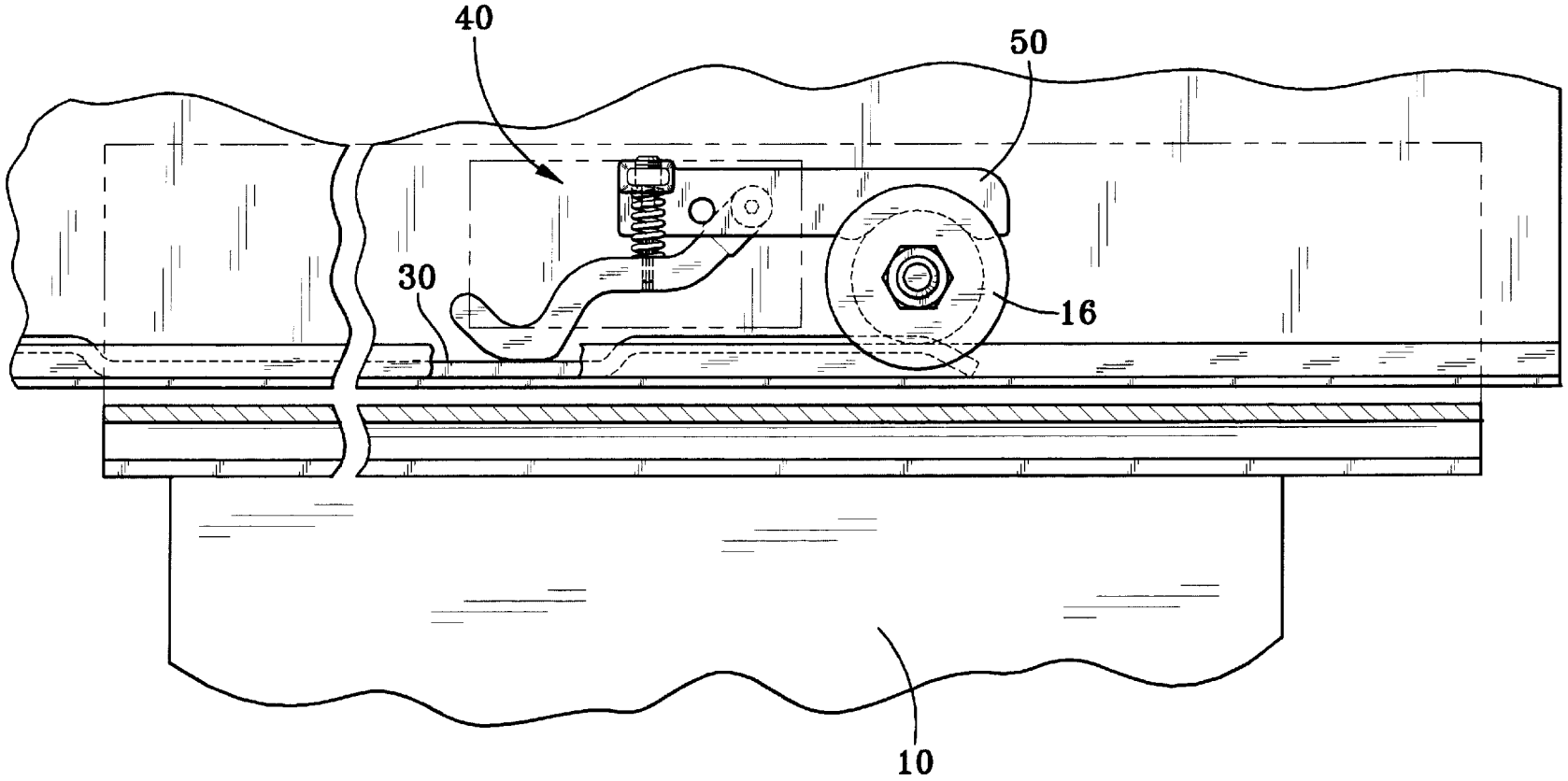
FIG. 1A is front view of the roller supported door shown in FIG. 1 with the door in a secondary control region of travel.
Figure 2:
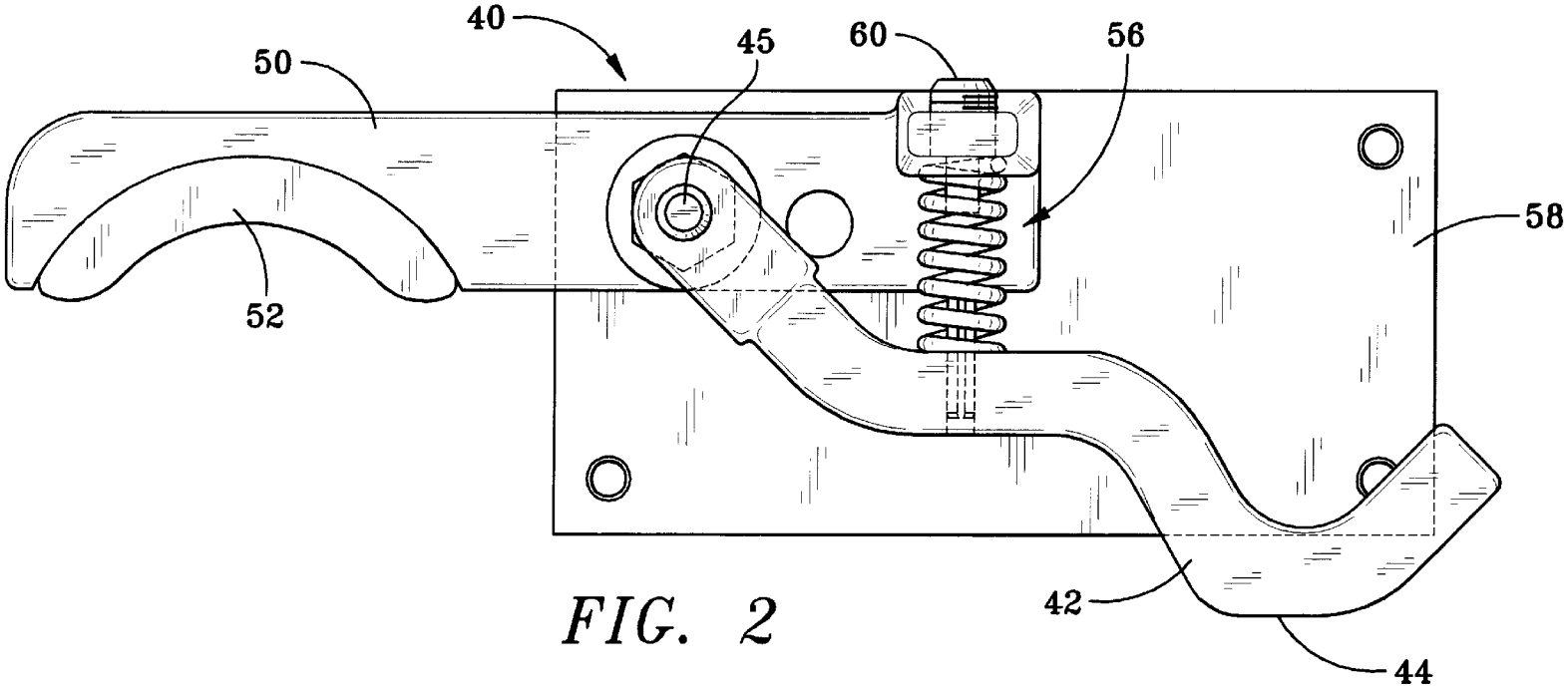
FIG. 2 is a rear view of the speed checking device shown in FIG. 1.
Figure 3:
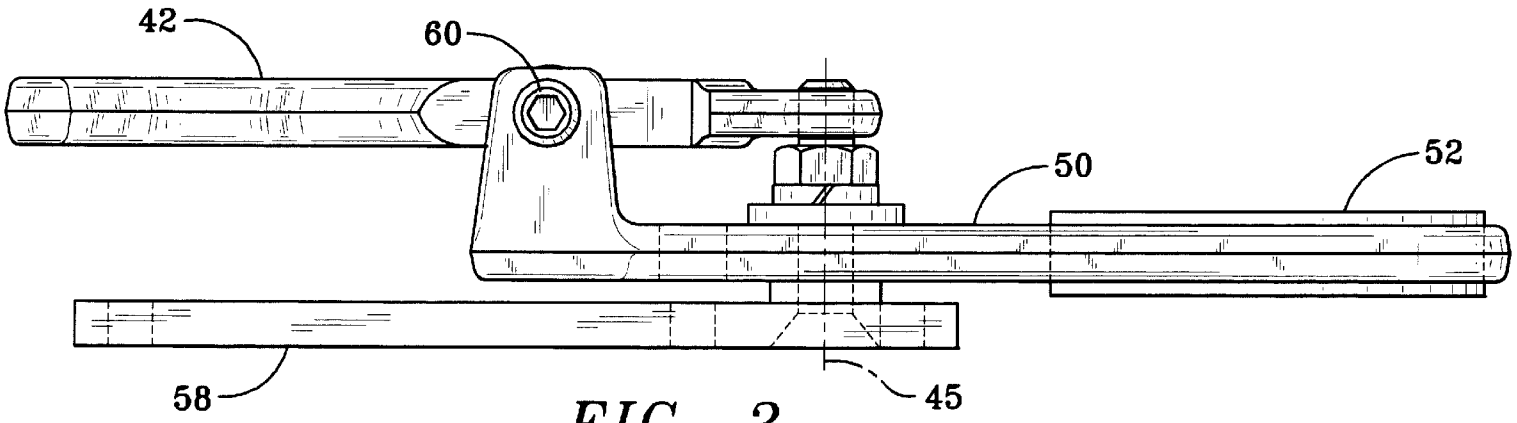
FIG. 3 is a top view of the speed checking device shown in FIG. 1.
Figure 4:
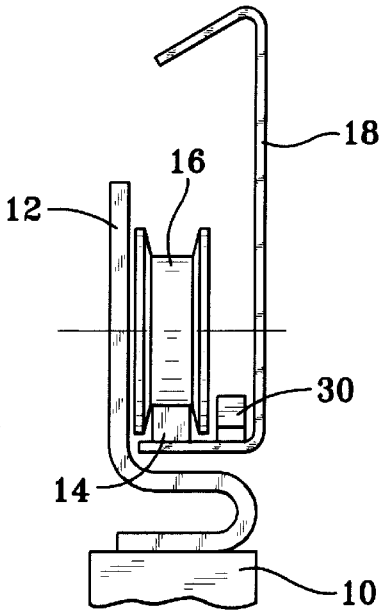
FIG. 4 is an end view of the door support mechanism shown in FIG. 1 illustrating the positioning of the speed checking device control track.
Figure 5:
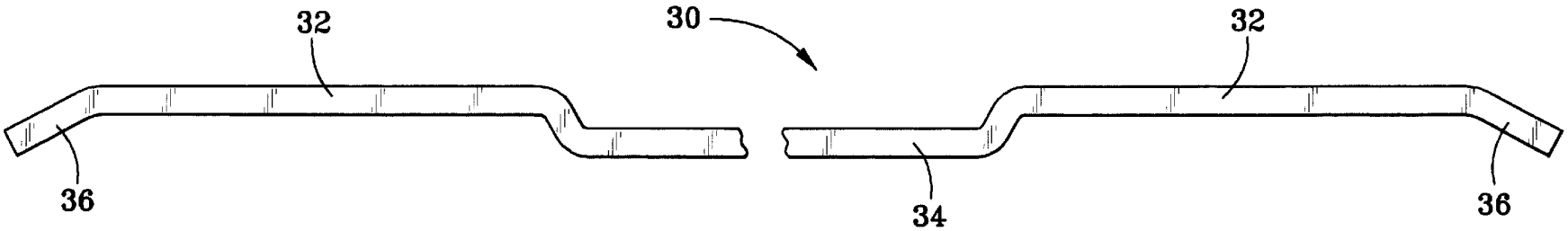
FIG. 5 is a side view of the control track shown in FIG. 1.

FIGS. 1 and 1A show a checking device or speed regulator 40, which is designed to control the cell door 10 with two different control levels. A stronger (primary) control or restraint is applied approximately 5 inches from completely closed and approximately 5 inches from completely open. In the preferred embodiment, in between the primary control regions, identified at 32 in FIG. 5, less force is applied to achieve a lesser degree of control or restraint to allow the door 10 to move in either direction smoothly. It is possible to apply no force between the controlled regions 32. When the door is closed, there is approximately 1 to 2 inches of free travel, identified at 36 in FIG. 5, to allow a spring loaded pin (not shown) in the door frame to move the cell door 10 out of reach of a latch bolt (not shown) when the doors 10 are unlocked electrically.

The cell door 10 and rollers 16 are attached to door hangers 12. The rollers 16 ride on a track 14, which is attached to door track mounting bracket 18. The rollers 14 allow the door 10 to move freely in either direction. A backing plate 58 of the checking mechanism 40 is also attached to one of the door hangers 12. A brake pad 52 attached to a brake arm or lever 50 rides on the small or inner diameter of roller 16, causing a braking action to control door speed as the door 10 is moved. As the door 10 is moved, a rocker arm or track follower 42 slides along a control track 30 attached to door track mounting bracket 18 applying a force through spring 56 to brake arm 50 which in turn pivots about pivot 45 forcing the brake pad 52 to apply pressure to roller 16. Preferably, both the rocker arm 42 and the brake arm 50 pivot about the pivot point 45. Preferably, when the contact point 44 of the rocker arm 42 passes beyond the end of primary control region 32 onto secondary control region 34, a lesser force is applied to roller 16. In some instances, it may be desirable to apply little or no force to roller 16 when the rocker arm contact point 44 is in the secondary control region 34. The lesser force applied in the secondary control region 34 allows the door 10 to slide smoothly. When the door 10 is approximately 5 inches from being completely opened (or, when moving in the opposite direction, closed) rocker arm contact point 44 reaches a second primary control region or raised area 32 on control track 30, causing the rocker arm 42 to lift, which in turn through spring 56 causes brake arm 50 to pivot applying more braking force through brake pad 52 to roller 16. The reverse action takes place when closing the door 10. In the preferred embodiment, the door 10 is under regulated control or checking at all times, in both the primary control regions 32 and the secondary control region 34, except at the very ends of the door travel, freewheeling regions 36. An adjusting screw 60 is provided to adjust the force applied by spring 56 to allow adjustment of the braking force on the roller 16.

If needed, additional checking mechanisms 40 can be added to provide additional braking force on additional rollers 16.

Having described the invention, what is claimed is:

1. In combination with a slidably mounted door having at least one roller thereon, a means for regulating the speed of the door, the means comprising:

a control track;

a spring biased track follower slidably engaging the control track;

a brake operably engaging the track follower, the brake engaging one of the door rollers.

2. The combination according to claim 1, wherein the control track has a raised portion at each end thereof.

3. The combination according to claim 1, wherein the brake includes a brake pad thereon.

4. The combination according to claim 1, wherein the track follower is pivotably attached to the brake.

5. The combination according to claim 1, further comprising a back plate, the brake being pivotally mounted to the back plate.

6. The combination according to claim 1, wherein the track follower is pivotally connected to the brake, the brake is pivotally connected to a back plate and the track follower axis of pivot is coincident with the brake axis of pivot.

7. The combination according to claim 1, wherein the track follower is biased by a spring connected to the brake.

8. In combination with a slidably mounted door having at least one roller thereon, a means for regulating the speed of the door, the means comprising:

a laterally extending control track having at least one primary control region and at least one secondary control region, the at least one primary control region being offset from an adjacent secondary control region;

a pivotally mounted brake operably engaging a door roller;

a track follower pivotally connected to the brake and slidably engaging the control track; and a biasing spring connected to the brake, the biasing spring biasing the track follower into contact with the control track.

9. The combination according to claim 8, wherein the control track has a primary control region at each end thereof with a secondary control region between the primary control regions.

10. The combination according to claim 9, wherein the control track has a ramped lead-in region at each end thereof.

11. In combination with a slidably mounted door having at least one roller thereon, a means for regulating the speed of the door, the means comprising:

a control track;

a pivotally mounted brake operably engaging a door roller;

a rocker arm pivotally connected to the brake and slidably engaging the control track; and a spring connected to the brake and engaging the rocker arm.

12. The combination according to claim 11, wherein the brake axis of pivot is coincident with the rocker arm axis of pivot.

13. The combination according to claim 11, wherein the control track has at least one primary control region thereon and at least one secondary control region thereon, the at least one primary control region being offset from an adjacent secondary control region.

14. The combination according to claim 11, wherein the brake includes a brake pad thereon.

15. The combination according to claim 14, wherein the brake pad is formed from a friction material.

* * * * *